US007976938B2

(12) United States Patent
Roby

(10) Patent No.: US 7,976,938 B2
(45) Date of Patent: Jul. 12, 2011

(54) LIGHTWEIGHT DECORATIVE CEMENTITIOUS COMPOSITE PANEL

(76) Inventor: John Roby, St Louis, MO (US)

( * ) Notice: Subject to any disclaimer, the term of this patent is extended or adjusted under 35 U.S.C. 154(b) by 570 days.

(21) Appl. No.: 11/537,131

(22) Filed: Sep. 29, 2006

(65) Prior Publication Data

US 2008/0078134 A1 Apr. 3, 2008

(51) Int. Cl.
*B32B 3/26* (2006.01)
*E04C 1/00* (2006.01)

(52) U.S. Cl. ..... 428/316.6; 428/319.1; 428/319.3; 428/311.51; 428/312.4; 428/71; 428/76; 52/309.4; 52/309.7; 52/309.12; 106/677

(58) Field of Classification Search ..... 428/316.6, 428/319.7, 319.9, 319.1; 52/309.4, 309.7, 52/309.12; 106/677
See application file for complete search history.

(56) References Cited

U.S. PATENT DOCUMENTS 4,774,794 A * 10/1988 Grieb ..... 52/309.7
5,058,345 A * 10/1991 Martinez ..... 52/309.11
5,966,885 A * 10/1999 Chatelain ..... 52/309.4
2002/0090871 A1* 7/2002 Ritchie et al. ..... 442/42

* cited by examiner

*Primary Examiner* — Hai Vo
(74) *Attorney, Agent, or Firm* — Schmid PA

(57) ABSTRACT

Disclosed is a decorative panel having a composite structure bonded by an elastomeric cementitious coating. The cementitious coating bonds together a foam core and glass fiber mesh to form a highly durable and lightweight decorative panel. The panel can further include a finish coat of a substantially maintenance free pigmented coating. The panel may be attachment to the exterior surface of barriers and bridges. The lightweight construction of the panel adds little weight to the structure it adorns while matching or exceeding the wear characteristics of the attached structure.

15 Claims, 3 Drawing Sheets

LIGHTWEIGHT DECORATIVE CEMENTITIOUS COMPOSITE PANEL

TECHNICAL FIELD

The present invention generally relates to lightweight composite panels and in particular to composite panels comprising a foam core and glass fiber mesh bond together with an elastomeric cementitious compound.

BACKGROUND

In response to local expectations and the traveling public, there has been a growing need for aesthetic improvement to such typical highway features as bridges and barriers. Specifically, requests for barrier treatments and enhanced bridge details that contribute to the overall aesthetic experience of the driving or traveling public are increasing. In response to such requests a substantial number of new road construction projects include decorative features in their design.

For example, concrete barriers (e.g., New Jersey and F-shapes and single slope and vertical face designs) are often the barriers of choice in urban and suburban environments. Many agencies and communities have expressed a desire for aesthetic treatments for these standard shapes. Additionally, local communities and agencies are also demanding that state DOTs provide bridge details with enhanced appearances.

The requested aesthetic details or items must be chosen with care since such must be both attractive and durable. Barriers and bridges are exposed to the elements such as rain and sunlight and to road pollutants such as exhaust and road salt. Such harsh environmental conditions would quickly corrode and mare most decorative structures used in construction. Furthermore, safety is always a concern in highway construction and a decorative item cannot be a hazard that decreases the safety of a roadway.

Thus, most decorative elements used to enhance roadways have been formed from either precast concrete or poured in place concrete features. Concrete is a familiar and readily available material that is often the preferred material of choice in most roadway construction projects given its proven history of superior performance. Decorative features formed from concrete are capable of withstanding the harshest of environmental conditions.

Decorative concrete features are durable but unfortunately such are extremely heavy. Highly dense and heavy concrete features are difficult to maneuver and set in place on a construction site. The required extra effort to place such a heavy article adds extra expense and time. Furthermore, some decorative concrete structures can be a road hazard in that such structures are solid and do not absorb impact.

Thus, what is needed is a decorative article that is durable like concrete but lacking the excessive weight of such concrete articles. Furthermore, it would be advantageous to have a decorative structure that is both lightweight and low in maintenance. The pigmenting of concrete structures typically requires recurring applications of paint. Thus, a decorative item that is durable, lightweight, safe, quick to install and that requires little maintenance would be highly desirable.

SUMMARY

The present invention provides for a decorative panel comprising a composite structure bonded by a cured cementitious acrylic emulsion. The cementitious composition bonds together foamed cores and glass fiber mesh to form a highly durable and lightweight decorative panel. The panel can be further coated with a substantially maintenance free pigmented coating. An intended use of the panel is for attachment to the exterior surface of such structures as barriers and bridges. The lightweight construction of the panel adds little weight to the structure it adorns yet the panel's wear characteristics typically exceed those of the attached structure.

In greater detail, the lightweight decorative cementitious composite panel comprises one or more foam cores having glass fiber mesh surrounding the core. The fiber glass mesh and foam core are bond together using a cured cementitious acrylic emulsion coating. The glass fiber mesh may be of varying weights and design. For example the mesh may be of a weight from 7 to 25 ounces per square yard and may be straight or pre-creased to form edges. The core may be formed from extruded polystyrene having a density between about 1 to 5 pounds per cubic foot. The composite panel may further include a finish coat comprised of a flexible pigmented finish.

A further embodiment of the present invention includes a lightweight decorative cementitious composite panel comprising opposed foam cores. The foamed cores, individually and combined, are substantially surrounded by a first glass fiber mesh having a weight of about 15 to 25 ounces per square yard. A second glass fiber mesh having preformed corner creases is used to define the edges of the panel. A cementitious elastomeric coating may then bind both the first and second mesh and the combined cores to form the composite panel. Typically, the elastomeric coating is a cured cementitious acrylic emulsion. The completed composite panel may be coated with siliconized pigmented finish.

An additional embodiment includes a lightweight decorative cementitious composite panel comprising a first and second opposed foam cores having a first glass fiber mesh surrounding the cores. A second glass fiber mesh defines the edges of the panel and a third glass fiber mesh may define a bump-out on the surface of the composite panel. The bump-out is typically a decorative feature that further enhances the appeal of the composite panel. A cementitious elastomeric coating is added which binds the first, second and third meshes and cores together. The composite panel may be further coated with a pigmented finish.

DRAWINGS

DETAILED DESCRIPTION

Disclosed is a lightweight decorative panel having a composite structure bonded together by an elastomeric cementitious coating. The composite panel includes a foam core substantially surrounded by glass fiber mesh and a cementitious coating binding composite structure together. Additionally, the visual appeal of the panel may be enhanced by adding bump-outs to the surface of the panel. Furthermore, a substantially maintenance free pigmented finish coat may be added to the panel. The durable panel may be attachment to such structures as barriers and bridges as a decorative enhancement.

Figure 1:
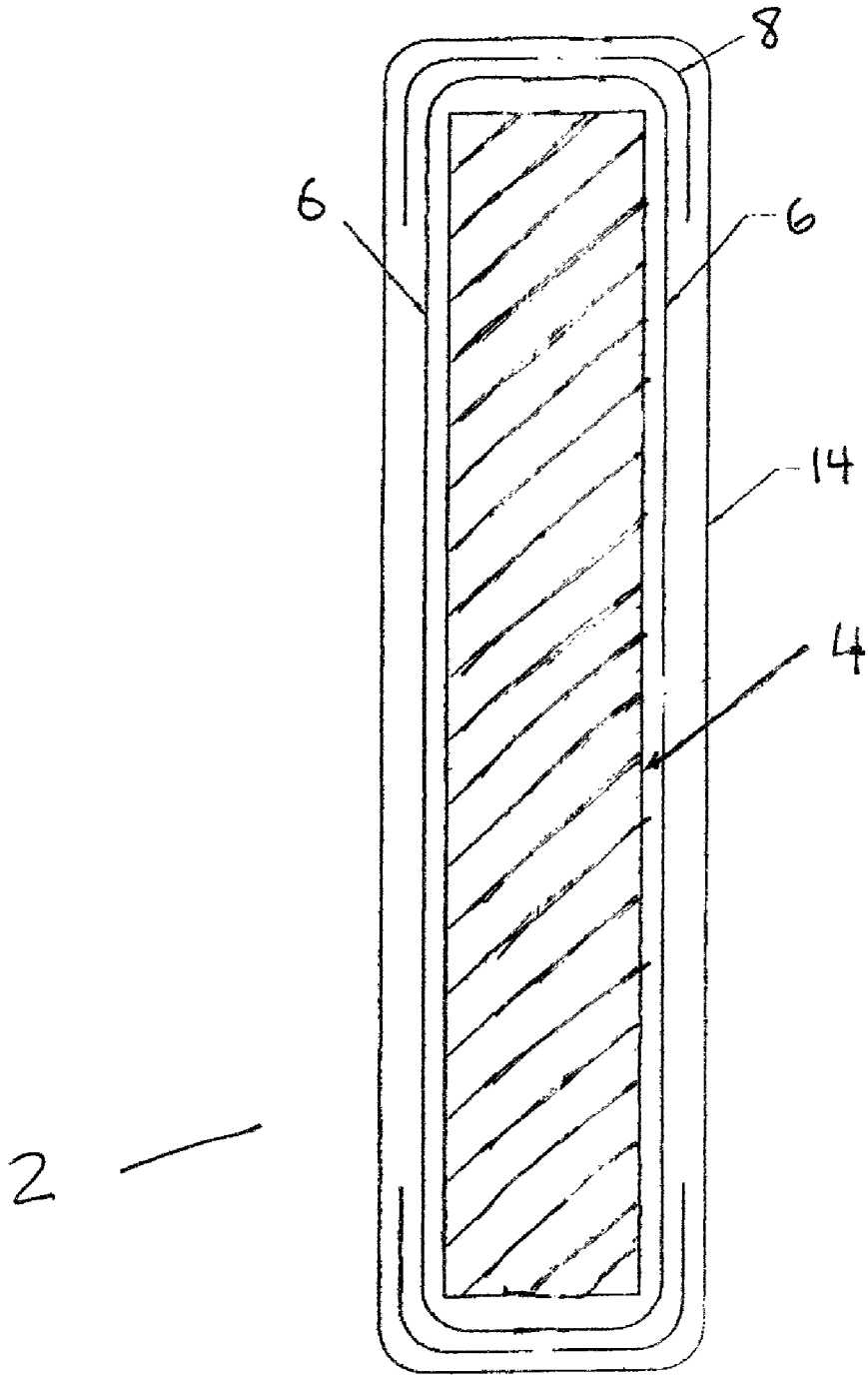
FIG. 1 depicts the an embodiment of the panel having a single foamed core surrounded by glass fiber mesh and bonded together in an elastomeric cementitious coating.
Figure 3:
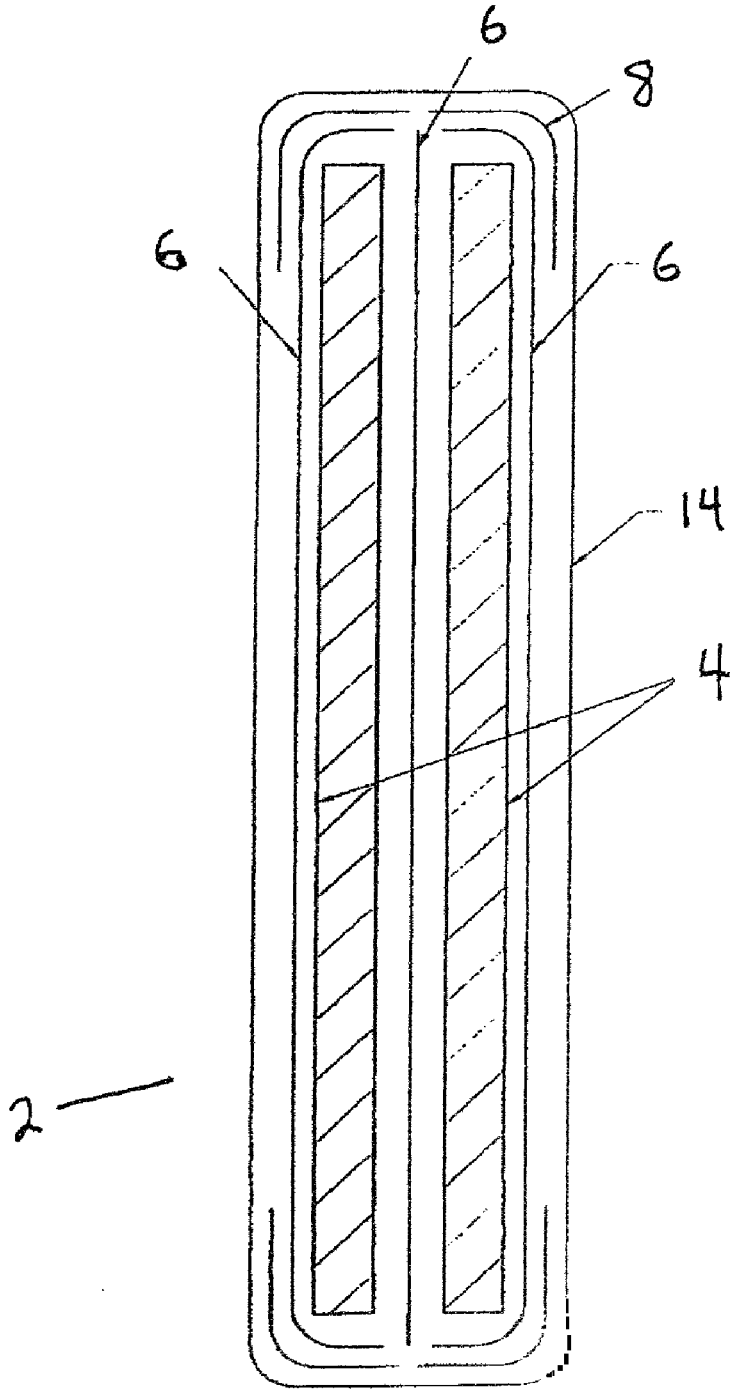
FIG. 3 depicts a further embodiment of the panel having two foamed cores surrounded by glass fiber mesh and bonded together in an elastomeric cementitious coating.

Turning now to the drawings where like numbers represent like items. FIG. 1 depicts an embodiment of the decorative panel 2 having at least one foam core 4 bonded together in an elastomeric cementitious coating 14. Figure illustrates the panel 2 having a bump-out 12 formed on the surface of the panel 2. FIG. 3 depicts a further embodiment of the panel having two foamed cores 4 surrounded by glass fiber mesh and bonded together in an elastomeric cementitious coating 14.

The foamed core 4 or cores may be comprised of a polystyrene. In one instance, the polystyrene foam may be extruded, however it is not intended that the present panel 2 be limited to the method of formation of the core 4 such that the core 4 may be a molded polystyrene. Additionally, it is contemplated that other foams may be used to form the core 4. By way of example and not limitation, the core 4 may be formed from polyurethane and polyisocyanurate foams.

While closed-cell foams have been specifically listed, the present panel 2 is not intended to be limited solely to cores 4 formed from closed-cell foams such that other foams including open-cell foams may be utilized. Furthermore, the foamed core 4 may be formed from a foam having a specific density. For example, the foamed core 4 may have a density between about 1 to about 5 lbs per cubic foot. In a further embodiment the foamed core 4 may have a density between about 2 to about 4 lbs per cubic foot. An additional embodiment includes the foamed core 4 having a density of about 3 lbs per cubic foot.

The decorative panel 2 may have one or more different types of glass fiber mesh, including those of varying weights and shapes. A fist type of glass fiber mesh includes the binding mesh or first glass fiber mesh 6 which imparts a structural integrity to the panel 2. The binding mesh 6 may be a coated glass fiber mesh 6 capable of imparting an impact resistance to the panel 2. An example of such a mesh would be Sto XX Armor Mat available from Sto Corp. of Atlanta, Ga. The binding glass fiber mesh 6 may have a weight from between about 15 to about 25 ounces per square yard. In a further embodiment the binding glass fiber mesh 6 may have a weight from between about 18 to about 22 ounces per square yard. An additional embodiment includes the binding glass fiber mesh 6 having a weight of about 20 ounces per square yard.

A second type of glass fiber mesh includes the corner mesh 8 or the second glass fiber mesh 8. The corner mesh 8 can be utilized to impart and define an edge to the panel 2 and may be coated. The corner mesh 8 may be a mesh manufactured to have a pre-crease that defines an edge. An example of such a mesh is Sto Corner Mat available from Sto Corp. of Atlanta, Ga. The corner mesh 8 may have a weight from between about 6 to about 9 ounces per square yard. In a further embodiment the corner mesh 8 may have a weight from between about 7 to about 8 ounces per square yard. An additional embodiment includes the corner mesh 8 having a weight of about 7.5 ounces per square yard.

Figure 2:
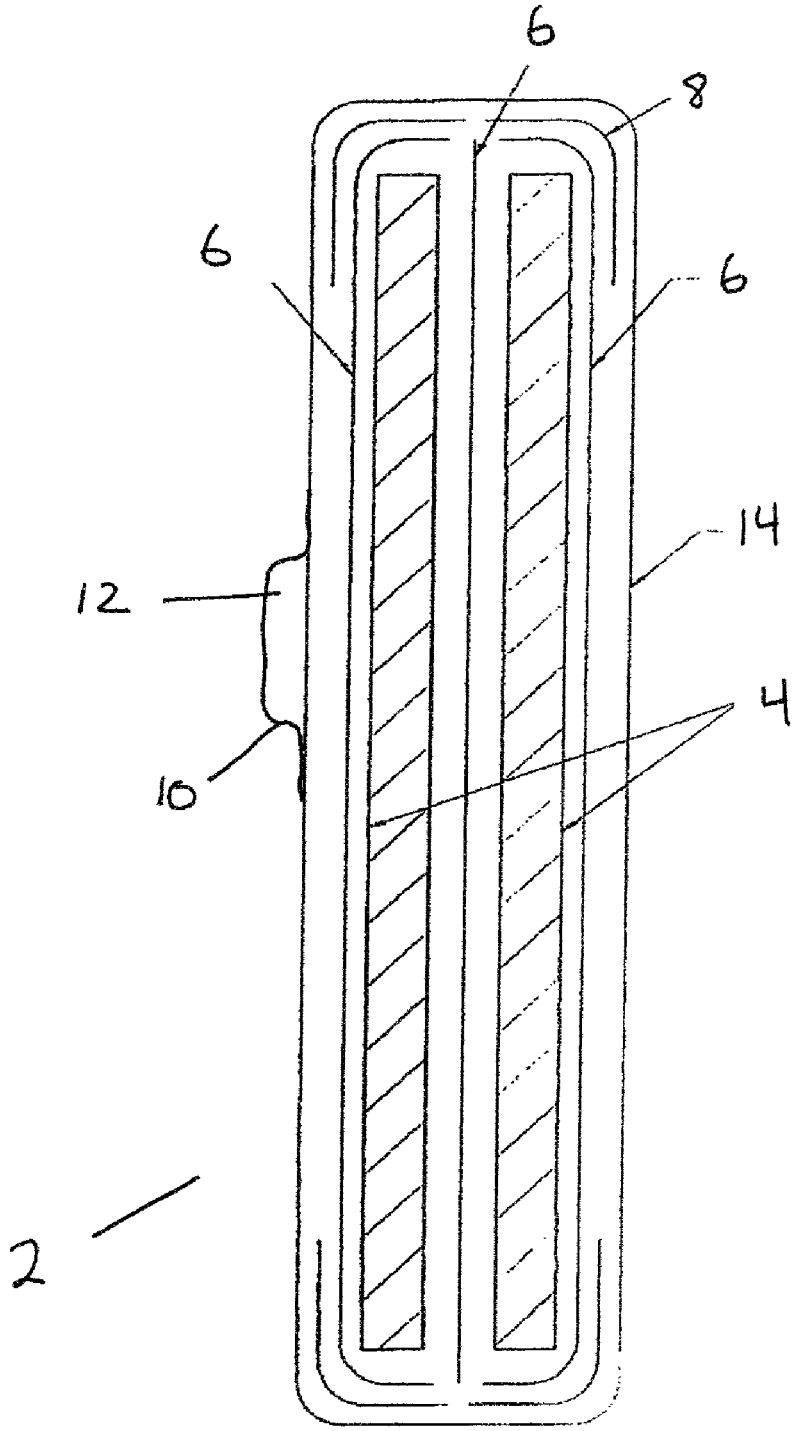
FIG. 2 illustrates the panel having a bump-out formed on the surface of the panel and comprised of a similar composition as the panel.

A third type of glass fiber mesh that may be incorporated into the present panel 2 is a bump-out mesh 10 or the third glass fiber mesh 10. The bum-out mesh 10 may be coated and is a flexible mesh capable of conforming to the shape of a bump-out 12 formed on the panel 2 as illustrated in FIG. 2. An example bump-out mesh 10 is Sto Repair Mesh available from Sto Corp. of Atlanta, Ga. The bump-out mesh 10 may have a weight from between about 7 to about 12 ounces per square yard. In a further embodiment the bump-out mesh 10 may have a weight from between about 8 to about 11 ounces per square yard. An additional embodiment includes the bump-out mesh having a weight of about 10 ounces per square yard.

The panel 2 is bound together using an elastomeric cementitious coating 14. The elastomeric characteristics of the coating 14 imparts, among other advantages, an impact resistance to the panel 2. The cementitious nature of the coating 14 imparts a durability to the panel 2. By way of example and not limitation the coating may be formed from a cured cementitious acrylic emulsion. An example of such an acrylic emulsion is Sto Watertight Coat® available from Sto Corp. of Atlanta, Ga. The coating 14 forms a bond between all the components of the present panel 2. For example, the coating 14 resides between the two opposed cores 4 and the binding mesh 6 positioned in between the opposed cores. Additionally, the coating 14 binds the glass meshes to the cores 4 and each other. The coating 14 may be applied and the panel 2 formed using any known method in the art.

A further embodiment of the present panel 2 includes the formation of bump-outs 12 defined on the surface of the panel 2. The bump-outs 12 form an additional decorative effect to the decorative panel 2. Bump-outs 12 can be formed in a similar manner to the present panel 2, except that the bump-out mesh 10 is used to define the bump-out 12 around a secondary foam core 16. The bump-out 12 is bound and attached to the face of the panel using the bump-out mesh 10 and elastomeric coating 14.

The decorative panel may further comprise a finish coat 18 applied to the out surfaces of the panel 2 by most any means known in the art. The finish coat 16 may include a decorative pigmented coat. Additionally, the finish coat 16 may be a flexible coating. By way of example and not limitation, one example of a flexible coating are those that are siliconized. An example of such a coating is Sto Powerflex Silco® available from Sto Corp of Atlanta, Ga.

While Applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

The invention claimed is:

1. A lightweight decorative cementitious composite panel having two major surfaces and two side edge surfaces, comprising:

a foam core;

a first glass fiber mesh having a weight between about 15 to about 25 ounces per square yard and surrounding the core;

a second glass fiber mesh having a crease defining the side edges of the panel and the second mesh having a weight between about 6 to about 9 ounces per square yard;

a third glass fiber mesh provided on the first glass fiber mesh, defining a decorative bump-out on one of the major surfaces of the composite panel; the third glass fiber mesh having a weight less than the first glass fiber mesh; and a cured cementitious acrylic emulsion in contact with the first, second and third glass fiber meshes and core, whereby the cured emulsion coats and bonds the meshes and core to form the composite panel.

2. The composite panel of claim 1, wherein the third glass fiber mesh has a weight between about 7 to about 12 ounces per square yard.

3. The composite panel of claim 1, wherein the foam core including a polystyrene.

4. The composite panel of claim 1, wherein the foam core has a density between about 1 to about 5 pounds per cubic foot.

5. The composite panel of claim 1, wherein the foam core includes first and second opposed foam cores, and the first glass fiber mesh and the cured cementitious acrylic emulsion further reside between the first and second opposed foam cores.

6. The composite panel of claim 1, further including a flexible pigmented finish coat.

7. A light decorative cementitious composite panel having two major surfaces and two side edge surfaces, comprising:

first and second opposed foam cores;

a first glass fiber mesh adjacent to the cores and residing between the first and second opposed foam cores;

a second glass fiber mesh having a crease and the crease defining the side edges of the panel and the second glass fiber mesh having a weight less than the first glass fiber mesh;

a third glass fiber mesh provided on the first glass fiber mesh, defining a decorative bump-out on one of the major surfaces of the composite panel; the third glass fiber mesh having a weight less than the first glass fiber mesh; and a cementitious elastomeric coating binding the first, second, third meshes and cores.

8. The composite panel of claim 7, the foam cores including a polystyrene and having a density between about 1 to about 5 pounds per cubic foot.

9. The composite panel of claim 7, wherein the cementitious elastomeric coating includes a cured cementitious acrylic emulsion.

10. The composite panel of claim 7, wherein the first mesh having a weight between about 15 to about 25 ounces per square yard.

11. The composite panel of claim 7, wherein the second mesh having a weight between about 6 to about 9 ounces per square yard.

12. A lightweight decorative cementitious composite panel having two major surfaces and two side edge surfaces, comprising:

first and second opposed foam cores;

a first glass fiber mesh surrounding the cores and residing between the first and second opposed foam cores;

a second glass fiber mesh having a crease and the crease defining the side edges of the panel, and the second glass fiber mesh having a weight less than the first glass fiber mesh;

a third glass fiber mesh provided on the first glass fiber mesh, defining a decorative bump-out on one of the major surfaces of the composite panel; the third glass fiber mesh having a weight less than the first glass fiber mesh; and a cementitious elastomeric coating binding the first, second, and third meshes and cores.

13. The composite panel of claim 12, further including a flexible pigmented finish coat.

14. The composite panel of claim 12, the foam cores including a polystyrene and having a density between about 1 to about 5 pounds per cubic foot.

15. The composite panel of claim 12, wherein the first mesh having a weight between about 15 to about 25 ounces per square yard.

* * * * *